United States Patent [19]

Weickert et al.

[11] Patent Number: 4,715,298

[45] **Date of Patent: * Dec. 29, 1987**

[54] ELECTRICALLY POWERED IMPRINTER

[75] Inventors: Walter R. Weickert, Petersburg; Paul J. Foley, Kitchener, both of Canada

[73] Assignee: National Business Systems, Inc., Ontario, Canada

[ * ] Notice: The portion of the term of this patent subsequent to Apr. 7, 2004 has been disclaimed.

[21] Appl. No.: 936,605

[22] Filed: Dec. 1, 1986

Related U.S. Application Data

[63] Continuation of Ser. No. 780,989, Sep. 27, 1985, Pat. No. 4,655,132.

[51] Int. Cl.[4] ..... B41F 3/04

[52] U.S. Cl. ..... 101/269; 101/56; 220/335

[58] Field of Search ..... 101/45, 56, 269, 270, 101/271, 272, 273, 274; 400/686; 49/379; 220/263, 264, 335

[56] References Cited

U.S. PATENT DOCUMENTS

| | | | |
|---|---|---|---|
| 3,416,441 | 12/1968 | Maul et al. | 101/56 |
| 3,420,171 | 1/1969 | Maul et al. | 101/269 |
| 3,447,459 | 6/1969 | Maziarka | 101/269 |
| 3,494,282 | 2/1970 | Gruss | 101/45 |
| 3,623,426 | 11/1971 | Gruss | 101/45 |
| 3,738,267 | 6/1973 | Zofchak et al. | 101/269 |
| 3,800,700 | 4/1974 | McInnis et al. | 100/269 |
| 4,085,675 | 4/1978 | Yoshikawa et al. | 101/269 |
| 4,097,145 | 6/1978 | Luperti et al. | 220/264 |
| 4,408,523 | 10/1983 | Senyitka | 101/269 |
| 4,418,619 | 12/1983 | Diel | 101/269 |
| 4,423,679 | 1/1984 | Maul, Sr. | 101/269 |
| 4,437,404 | 3/1984 | Barbour | 101/269 |
| 4,460,105 | 7/1984 | Cox | 220/335 |
| 4,655,132 | 4/1987 | Weickert et al. | 101/269 |

FOREIGN PATENT DOCUMENTS

| | | | |
|---|---|---|---|
| 1580457 | 12/1980 | United Kingdom | 101/269 |

OTHER PUBLICATIONS

"Securing Element for Axles & Shafts"; IBM Tech. Discl. Bull., vol. 27, No. 12, pp. 7063, May 1985.

*Primary Examiner*—Edgar S. Burr
*Assistant Examiner*—David A. Wiecking
*Attorney, Agent, or Firm*—Antonelli, Terry & Wands

[57] ABSTRACT

A motor operated imprinter is disclosed. The imprinter is easy to use as a consequence of the print bearing elements and formset being retained on a generally horizontal disposed surface. A head bearing a rolling platen is pivoted from an open position which exposes the surface for retaining the print bearing element and the formset to a closed position to activate the motor and the imprinting cycle. A brake mechanism including a head anester is provided to slow the opening movement of the head after the imprinting cycle.

28 Claims, 13 Drawing Figures

20
16
18
125
30
22
210
196
136
204
202
200
206
140
208
138
194
192
190
152
38
154
131
128
138
146
34
142
144
12
134
36
176
150
148
132
130
32
126

ELECTRICALLY POWERED IMPRINTER

This application is a continuation of U.S. Ser. No. 780,989, filed Sept. 27, 1985, now U.S. Pat. No. 4,655,132, issued 4/7/87.

BACKGROUND OF THE INVENTION

1. Field of the Invention

The invention relates to motor operated imprinters which imprint a printed record on a formset from one or more print bearing elements. More particularly, the invention relates to imprinters of the aforesaid type which have a generally horizontally disposed surface which receives the print bearing elements and the formset to be imprinted in preparation for imprinting when a head mechanism carrying a rolling platen is in an open position and which imprint the formset when the head mechanism is in a closed position.

2. Description of the Prior Art

Imprinters have been used for many years to record credit transactions. Typically, an imprinter is a manually operated device in which a customer's credit card and merchant's station plate, a dater, and optionally, a variable money amount printing mechanism are located on different parts of a surface which receives a formset to which an imprint of the aforementioned elements is transferred by the rolling of a rolling platen over the formset.

In addition to the above-described manually operated imprinters, motor operated imprinters have been in use for many years which use an electric motor to activate the traversal of the rolling platen across the formset to generate an imprint. These systems relieve the operator of the requirement of manually supplying the power for performing the imprinting operation. U.S. Pat. Nos. 3,232,230, 3,233,542, 3,416,441, 3,420,171, 3,447,459, 3,494,282, 3,623,426, 4,408,523, 4,423,679 and 4,437,404 each disclose motor operated imprinters.

These imprinters belong to three main groups. The first group, which includes those imprinters disclosed in U.S. Pat. Nos. 3,232,230, 3,233,542, and 3,447,459 have heads which are mounted on a fixed track which is traversed from a position offset from the printing surface across the printing surface and back. These imprinters permit the user to easily position the credit card and formset on the printing surface, but suffer from the disadvantage that they are not compact in length because of the fact that the head is parked in a position offset from the printing surface. The second group of imprinters, which are disclosed in U.S. Pat. Nos. 3,416,441, 3,420,171, 3,494,282, 3,623,426, and 4,437,404, have a pivoted head which is generally vertically disposed for receiving the formset and credit card to be imprinted. The printing operation of these imprinters is activated by the closing of the head into a latched position. A rolling platen fixedly mounted within the stationary base is traversed across the formset by the activation of the motor when the head is rotated to its latched position. These imprinters can be difficult to use because of the necessity to insert the customer's credit card and formset into the generally vertically dispsoed head mechanism, especially under circumstances where lighting conditions are not bright, such as occurs in bars and restaurants. The third type of imprinter is disclosed in U.S. Pat. Nos. 4,423,679 and 4,408,523 which has a generally horizontally disposed surface for receiving the credit card to be imprinted and the fromset while a pivotable head is in an open position in preparation for imprinting and which imprints the formset upon latching of the head in a closed position. This third type of imprinter does not have a simple mechanism for transmitting power from a motor located in the base to the pivoted head. Moreover, the mechanism for mounting the rolling platens in the head mechanism causes the head to be relatively thick which is undesirable for applications where compactness of the imprinter is important.

An important consideration in marketing a motor operated imprinter to hotels, restaurants and bars is its compactness, because of counter space considerations, and the ease of inserting the credit cards and formsets because of ligthing conditions. Additionally, a "feel" of durability which is conveyed by a rugged construction is important.

SUMMARY OF THE INVENTION

The present invention is an improved motor operated imprinter of the type disclosed in the third category of patents described supra, and has advantages over the prior art motor operated imprinters described, supra. In the first place, the mechanism for transmitting power from the base to the pivotable head is simple and compact. The mechanism for mounting the carriage in the head minimizes the thickness of the head which is important in applications where an imprinter of minimal height is desired. The imprinter has a durable construction which provides for a long service life and is compact which is important in many applications where it is desired to have the smallest possible counter space allotted to a credit card imprinter. The head mechanism is easy to close and positively latches to achieve high quality imprints.

A motor operated imprinter in accordance with a first embodiment of the present invention includes a base having a generally horizontally disposed surface for receiving a print bearing element having printing to be imprinted and a print receiving element to be imprinted with at least the printing born by the print bearing element; a head pivotably connected to the base which is rotated from an open position, which provides access to the surface for receiving and for positioning and removal of the print bearing element and the print receiving element, to a closed position which positions the head for imprinting; a movable carriage mounted in the head, the carriage having mounted therein a rolling platen which is movable from a home position to a print complete position to cause imprinting of the printing on the print receiving element when the head is in its closed position by rolling contact of the rolling platen over the print receiving element and the print bearing element and back to the home position to perform another imprinting cycle; a motor mounted in the base for applying power to move the rolling platen to at least its print complete position; a transmission coupling the motor to the carriage for causing the rolling platen to move from its home position toward its print complete position upon activation of the motor the transmission including a coupling mechanism which is rotatable in both a horizontal and a vertical direction which couples the transmission to the carriage and which causes the carriage to be moved to its home position upon closure of the head. Further in accordance with the invention a latching mechanism is provided having an unlatched and a latched position for holding the head in its closed position. A switch is closed by the latching of the latching mechanism to activate the motor to cause the rolling platen to move from its home position toward its print complete position and is opened to deactivate the motor after the rolling platen has moved to the print complete position. An unlatching mechanism is activated by a movement of the rolling platen to its print complete position to unlatch the latching mechanism. An opening mechanism causes the head to rotate to its open position upon the unlatching of the latching mechanism.

A mechanism is provided for braking the rate of rotation of the head to its open position. The mechanism for braking the rotation of the head to its open position includes a head arrestor which is movable from a first position which does not engage the head to a second position into engagement with part of the head during rotation of the head to the open position to brake the rotation of the head to the open position; and a mechanism for moving the head arrestor from the first postion toward the second position into engagement with the part of the head in response to movement of the platen toward the print complete position which causes the head to rotate to the open position at a braked rate of rotation. The head arrestor is a member which extends upward from the point of attachment to the base to at least a point which engages the mechanism for moving the head arrestor. The head arrestor has a thin flexible section which bends when the head arrestor is moved from the first position to the second position. Furthermore, the head arrestor includes an adjustment mechanism for adjusting the position at which the mechanism for moving the head arrestor engages the head arrestor to cause movement from the first position. The adjuster may be a threaded member which engages a threaded bore in the head arrestor. Preferably, the head arrestor is made from palstic such as DELRIN. The mechanism for moving the head arrestor includes a pivoted member attached to the base with a cam engaging surface located at a point remote from the pivot point which has a protrusion at a point intermediate the pivot point and the cam engaging surface that engages the head arrestor upon pivoting of the pivoted member; and a cam which is rotated upon activation of the motor which engages the cam engaging surface when the the rolling platen is moving to its print complete position to cause the pivoted member to rotate to a position where the protrusion has moved the head arrestor to its second position whereby upon unlatching of the head, the head arrestor engages projections of the head to brake the rate of opening of the head.

The latching mechanism includes a pair of latches which respectively have a rotatable mounting point on different ends of the base. The latches each have notches cut at a point remote from the rotatable mounting point to the base for receiving a pair of projections at opposed ends of the head for latching the head in its closed position. The pair of latches are spring biased to rotate in a direction to cause the notches to engage the projection. A movable pawl is provided for engaging one of the latches in a first position to stop the rotation of the one latch prior to rotation to a position where the notches engage the projections. The pawl is movable to a second position by engagement with one of the projections to cause the notches of the latches to rotate into engagement with the projections to lock the head in its closed position. The rotatable mounting of one of the latches to the side of the base has an eccentric adjustment for varying the pivot point of the latches with respect to the base.

The coupling mechanism includes a rotatably mounted vertically extending bell crank with an arm extending horizontally from the crank which is rotated in response to activation of the motor to cause rotation of the crank; and an arm with first and second ends pivotably connected at the first end to the crank which is rotatable in a vertical direction with a second end of the arm coupled to the movable carriage. The secon end of the arm has a coupling which permits the second end to move with respect to a point of attachment to the carriage as the rolling platen moves to its home position upon closure of the head.

The carriage comprises a frame having a plurality of wheels for rotatably supporting the rolling platent during movement from the home position to the print complete position; and a pull link having a first end pivotably connected to the frame and a second end pivotably connected to the second end of the arm of the coupling mechanism. The pull link pivots with respect to the frame and pivots with respect to the second end of the arm as the head pivots from its open position to its closed position while the arm pivots vertically with respect to the end of the bell crank. The plurality of wheels are rotatably mounted on axles attached to the frame. Each of the wheels engages a flat undersurface of the head upon movement of the rolling platen from the home position to the print complete position. The head includes a pair of opposed channels extending longitudinally in a direction parallel to the direction of motion of the carriage which engage guides extending outward from opposed sides of the frame to retain the carriage in a uniformly spaced relationship with respect to the flat surface of the head for the return of the rolling platen from the print complete position to the home position. The carriage further has a retainer for removably retaining the rolling platen. Opposed sides of the frame which are parallel to the channels each have a vertically projecting U-shaped slot for rotatably supporting an axle. The rolling platen is mounted on an axle which is rotatably supported within the U-shape slots. Each slot has an associated axle retainer for retaining the axle of the platen during movement of the platen but which may be removed by applying a downward force to the axle sufficient to overcome a retaining force. A card retainer projects downward from the head which holds the print bearing element firmly in place on the surface for receiving while the head is in the closed position.

The cam which activates the pivoted member for moving the head arrestor to the second position in preferably part of the bell crank.

The transmission includes a cam rotatably driven in response to the activation of the motor which has first and second control surfaces for respectively controlling the activation cycle of the motor when the head is unlatched and the unlatching of the latching mechanism in response to movement of the rolling platen to its print complete position. A mechanism is provided for coupling the cam with first and second surfaces to the bell crank to cause the rolling platen to move from its home position to its print complete position and partially back to its home position when the motor is activated. The closure of the switch is controlled by the first surface of the cam after the latching mechanism is unlatched until the cam rotates to a parked position; and the latching mechanism is unlatched by the second surface of the cam in response to movement of the rolling platen to its print complete position.

The motor has an output shaft disposed vertically downward and is mounted in the base in a position generally below the home position of the rolling platen and the transmission has an output and an input which is coupled to the output shaft of the motor and is mounted in the base at a position generally below the print complete position of the platen. The output of the transmission drives the cam with the first and second surfaces and the motor shaft is coupled to the input of the transmission with a belt drive.

The mechanism rotatably coupling the cam with the first and second surfaces to the coupling mechanism comprises a linkage having first and second ends with the first being pivotably connected to the cam and the second end being pivotably connected to the arm of the bell crank, An unlatching mechanism is provided for unlatching the head from its closed position when the motor is deactivated. The unlatching mechanism rotates a common axle of the latching mechanism to cause unlatching. The unlatching mechanism includes a release lever mounted in the base which is movable from a first position to a second position; and a linkage, coupled to the release lever and to the latching mechanism via the common axle, which moves in response to movement of the release level from the first position to the second position to cause the latching mechanism to be unlatched.

The surface for receiving the print carrying element and the print receiving element is a flat surface having areas for holding at least the print bearing element and the print receiving element in a fixed position; and has an adjustment mechanism for adjusting the vertical position of the flat surface with respect to datum surfaces in the base to achieve a desired position of the surface for receiving with respect to the rolling platen when the head is in its latched position. The mechanism for adjusting further includes a plurality of height adjusters which engage the surface for receiving and datum surfaces contained in the base to establish a position of the surface for receiving with respect to the base. Further, a fastening mechanism is provided for connecting the surface for receiving to the base to fixedly establish the vertical position of the surface for receiving with respect to the base which is determined by the height adjuster.

The motor includes a positive brake for stopping the rotation of the motor in response to the opening of the switch to cause the rolling platen to be stopped in a fixed position after the head is opened to insure proper positioning of the rolling platen prior to closure of the head.

A motor operated imprinter in accordance with a second embodiment of the invention includes a base having a surface for receiving a print bearing element having printing to be imprinted and a print receiving element to be imprinted with the printing; a head pivotably connected to the base, which is rotatable from an open position which provides access to the surface for receiving, for positioning and removal of the print bearing element and print receiving element, to a closed position which positions the head for imprinting, the head having an opening mechanism to cause the head to rotate to an open position from the closed position; a movable carriage mounted in the head, the carriage having mounted therein a rolling platen which is movable from a home position to print complete position to cause imprinting of the printing on the print receiving element when the head is in its closed position by rolling contact of the rolling platen over the print receiving element and the print bearing element and back to the home position to perform another imprinting cycle; a motor mounted in the base for applying power to move the rolling platen to at least its print complete position; a transmission coupling the motor to the carriage for causing the rolling platen to move from its home position toward its print complete position upon activation of the motor; a mechanism for latching the head in the closed position and unlatching the head; and a brake for braking the rate of rotation of the head from the closed position to the open position to a rate slower than the rate of rotation caused by the opening mechanism to cause the rotation of the head from the closed position to the open position.

The brake includes a head arrestor which is movable from a first position which does not engage the head to a second position into engagement with a part of the head during rotation of the head to the open position to brake the rate of rotation of the head to the open position; and a mechanism for moving the head arrestor from the first position toward the second position into engagement with the part of the head in response to movement of the platen toward the print complete position which causes the head to rotate at the braked rate of rotation. The head arrestor comprises a member which extends upward from a point of attachment to the base to at least a point which can engage the means for moving the head arrestor, the member having a flexible section which bends when the head arrestor is moved from the first position to the second position. The head arrestor further comprises an adjusting mechanism for adjusting the position at which the means for moving the head arrestor engages the head arrestor to cause movement from the first position. The mechanism for adjusting is preferably a threaded member which engages a threaded bore in the head arrestor. The head arrestor is preferably made from plastic.

A third embodiment of a motor operated data recorder in accordance with the invention includes a base having a surface for receiving a print bearing element having printing to be imprinted and a print receiving element to be imprinted with the printing, the surface for receiving having a flat platen raised above a surrounding surface for supporting the print bearing element during imprinting and a retainer for retaining the print bearing element in a fixed position with respect to the flat platen with opposed edges of the print bearing element extending outward from opposed edges of the flat platen; a head pivotably connected to the base, which is rotatable from an open position which provides access to the surface for receiving, for positioning and removal of the print bearing element and print receiving element, to a closed position which positions the head for imprinting; a movable carriage mounted in the head, the carriage having mounted therein a rolling platen which is movable from a home position to a print complete position to cause imprinting of the printing on the print receiving element when the head is in its closed position by rolling contact of the rolling platen over the print receiving element and the print bearing element and back to the home position to perform another imprinting cycle; a motor mounted in the base for applying power to move the rolling platen to at least its print complete position; a transmission coupling the motor to the carriage for causing the rolling platen to move from its home position toward its print complete position upon activation of the motor; a latch for latching the head in the closed position and unlatching the head; and a retainer for retaining the print bearing element in a fixed vertical position with respect to the flat platen during imprinting which contacts a top surface of the print bearing element when the head is in its closed position. The retainer for retaining the print bearing element in a fixed vertical position is a member connected to the head which projects downwardly to contact the print bearing element when the head is closed. The member preferably is connected to a back part of the head and is L-shaped.

DESCRIPTION OF THE PREFERRED EMBODIMENTS

I. General Description

Figure 1:
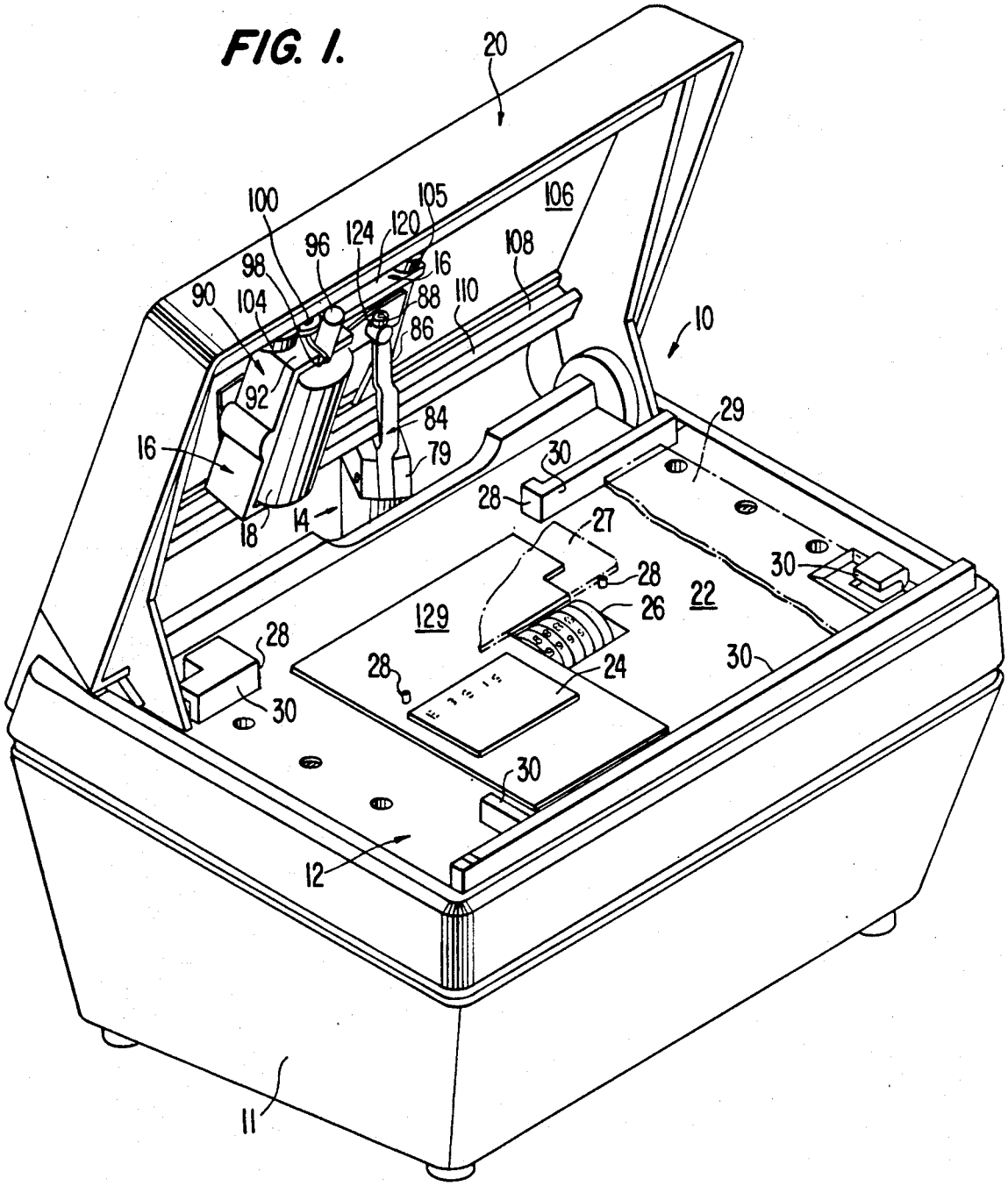
FIG. 1 is a general perspective view of an imprinter in accordance with the invention with the head in the open position.

FIGS. 1, 2, 3 and 4 illustrate a motor operated imprinter 10 generally in accordance with the inventio. The imprinter is contained in housing 11. For clarity of understanding the operation of the invention, the housing 11 is illustrated in only FIG. 1. A base 12 contains an electric motor and a transmission to be described, infra, which transmits rotary power from the motor to a coupling mechanism 14 which drives a carriage 16 carrying a rolling platen 18. The carriage 16 is movably mounted within head 20 which is pivoted from an open position as illustrated to a closed position for imprinting. A receiving surface 22 is attached to the base 12. The receiving surface 22 contains conventional elements such as a station plate 24, dater 26, retainer 28 for a credit card 27 and retainer 30 for retaining a formset 29 on which print from the station plate, dater and credit card are to be imprinted, such as a multisheet formset with interleaved carbon paper as in conventional. It should be noted that the receiving surface 22 is generally horizontally dispsoed to provide the user with complete visual access to position the credit card 27 and formset 29 within the respective retainers 28 and 30. In the preferred embodiment, the front of the receiving surface is tipped toward the vertical approximately 10°. In the nonoperating condition, as illustrated in FIG. 1, the head is pivoted to an open position which provides the aforementioned access for a user to position a credit card and formset on the receiving surface 22. When the head is pivoted to its closed position, the rolling platen 18 is moved to the left to assume its home position. Once the head 20 is latched in the closed position, the motor is activated to cause the rolling platen to move from its home position across the station plate 24, dater 26 and the credit card 27 retained in credit card retainer 28 to form an imprint on a formset 29 contained in the retainer 30. The imprinting cycle is completed when the rolling platen 18 has moved all the way to the right past the credit card 27 retained on retainer 28 and the dater 26. The generally horizontally disposed receiving surface 22 facilitates the usage of the imprinter by permitting the user full view of the surface on which the credit card 27 and formset 29 must be positioned prior to imprinting which is a disadvantage of imprinters which receive the credit card and formset in a general vertical position. A latching mechanism 32 locks the head in its closed position. A pair of springs 34 for causing the head to rotate to its open position, are attached between the base 12 and the head 20. A braking mechanism 36 is provided on one end of the base 12 to brake the rate of rotation of the head 20 to its open position once the head is unlatched when the rolling platen 18 has travelled to its print complete position at the right end of the receiving surface 22. The base 12 has a switch 38 mounted therein which controls the activation of the motor as described, infra. The motor is initially activated upon the latching of the latching mechanism 32 to cause closure of the switch 38. A cam, described infra having two control surfaces, controls the continued activation of the motor after initial activation by the closure of the latching mechanism 32 until the cam rotates to a parked position which causes the rolling platen 18 to assume a position as illustrated in FIG. 1 and unlatching of the latching mechanism when the rolling platen reaches its print complete position at the righthand side of the receiving surface 22 which causes the head 20 to rotate to the open position to prevent imprinting from occurring on the return stroke. A release lever, described infra, is provided in the bottom of the base for unlatching the latching mechanism 32 when it is desired to open the head after the latching mechanism has been latched, such as when a power failure occurs or on jamming of the rolling platen during imprinting.

II. Power Train

FIGS. 4, 9, 10, 12 and 13 illustrate the power train of the present invention. The power train includes a motor 40 and a transmission 46. The transmission of power from the motor 40 to the rolling platen 18 is as follows. The motor 40 contains a positive brake 42 which stops the motor in a fixed position upon the opening of the switch 38 to cause the rolling platen 18 to assume the position as illustrated in FIG. 1. In order to prevent severe shock to the motor, the positive brake 42 includes a slip coupling 43 which permits the motor shaft to turn approximately one turn after the positive brake is activated by opening of switch 38. Preferably, the positive brake is activated when element 43' rotates away from the motor 40 which occurs when the switch 38 opens. Activation of the motor 40 causes element 43' to be pulled, i.e. by magnetic attraction, into contact with the side of the motor which prevents a braking pawl 43" from engaging slip coupling 43. The element 43' rotates away from the side of the motor 40 upon opening of the switch 38 which stops the magnetic attraction, and the pawl 43" engages the slip coupling 43 which stops the motor 40 after approximately one rotation. The stopping of the motor in a desired position, assures that the rolling platen 18 will always be returned to its home position once the head 20 is pivoted to its closed position. The output of the motor 40 is coupled by belt drive 44 to pulley 45 which is connected to the input shaft of transmission 46. The transmission 46 is of conventional design. The output speed of the transmission 46 is reduced by approximately a ratio of 72:1 to the rotational speed of the motor 40. The motor 40 preferably is powered by alternating current. The output 48 of the transmission 46 is connected to cam 50 which has first and second control surfaces 52 and 54. The first control surface 52 has a parked position 56 which is the position where the motor 40 is deactivated to cause the rolling platen 18 to be parked as illustrated in FIG. 1. The cam 52 has an increasing diameter as the cam is rotated in the clockwise direction from the park position 56. When the cam rotates to position 58, the switch 38 is closed by the movement of contact arm 60 toward the front of the base 12. The second surface 54 controls the unlatching of the latching mechanism 32. The surface of the second control surface 54 defined between park position 62 and unlatching position 64 does not cause unlatching of the latching mechanism 32. Once the second surface 54 rotates past position 64, which occurs when the rolling platen 18 has moved to the print complete position at the right-hand side of the receiving surface 22, the latching mechanism 32 as described, infra, is opened which causes the head 20 to rotate to the open position under the action of springs 34. A connecting pin 66 is joined to the cam 50 at a point adjacent to the park postion 56 of the first surface 52. Arm 68 is pivotably connected to connecting pin 66. The arm 68 is pivotably connected to a coupling mechanism 70. A diagram of the electrical control circuit of the motor 40 has been omitted because of the simplicity of the control of the activation of motor 40 by a single switch.

The coupling mechanism 70 has a vertically extending bell crank 72 having a vertical axis of rotation which is journalled in the base 12 by a suitable bearing (not illustrated). An arm 74 of the bell crank 72 is connected to arm 68. Rotation of the bell crank is caused by rotation of the cam 50. The top part 76 of bell crank 74 has a slot 78 having bifurcated parts 79. A screw 80 extends across the bifurcations at the top part thereof and a pin 82 extends across the lower part of the bifurcations as illustrated. The screw 80, in conjunction with pin 82, acts to retain vertically pivotable arm 84 in a manner which is freely rotatable and not subject to wear as a consequence of a large number of imprinting cycles. The bell crank 72 rotates about its vertical axis of rotation when the head 20 is in its closed position to power the rolling platen 18 during imprinting. The vertically pivotable arm 84 rotates vertically downward from the position, as illustrated in FIG. 1, to a generally horizontally disposed position when the head 20 is rotated to its closed position. The end 86 of the vertically pivotable arm 84 has a pin 88 which forms a rotatable and slidable coupling for connection to the carriage 16 as described, infra. Upon closure of the head 20, the bell crank 72 rotates from the position, as illustrated in FIG. 1, through an angle of approximately 60° to move the rolling platen 18 from its home position to the left of the station plate 24 and retainer for credit cards 28 to the print complete position which is all the way to the right of the retainer 28 for credit cards. Once the rolling platen 18 moves to its print complete position, the latching mechanism 32 is unlatched which permits the head 20 to become unlatched and open. As the head 20 rotates from its closed position to its open position, the bell crank 72 rotates back through 60° and the arm 84 pivots vertically upward to assume the position as illustrated in FIG. 1. The cam surface 52 of cam 50 causes the motor 40 to be activated to rotate the bell crank 72 in a clockwise direction back to the park position as illustrated in FIG. 1 at which point the motor 40 is deactivated.

III. Carriage

The carriage 16 is illustrated in FIGS. 1, 5, 6 and 7. The carriage 16 has a frame 90 which has a rectangular outside shape. The carriage has a pair of downwardly depending sides 92 which have a pair of U-shaped slots 94 for receiving an axle 96 of rolling platen 18. A pair of spring retainers 98 ar attached to the downwardly depending sides 92 by a screw 100 for retaining the spring retainers. However, other attaching mechanisms may be used in place of screw 100. The spring retainers 98 apply an inward and upward force which forces the axle 96 upward into surface contact with the U-shaped slots 94 to retain the rolling platen 18 during operation of the imprinter. However, to change the rolling platen 18, it is only necessary to pull downwardly on the axle 96 with sufficient force to spread the spring retainers 98 apart to permit the axle to be pulled from engagement with the U-shaped slots 94. A solid axle 102 extends through apertures in the downwardly depending sides 92 to support a pair of wheels 104. A pair of axles 103 are attached to opposed sides 120 and 122 of frame 90. The axles 102 and 103 respectively rotatably support the wheels 104 and 105 which roll in surface contact with the underneath surface 106 of the head 20 during movement of the rolling platen 18 from the home position to the print complete position. The carriage 16 is guided for movement from the print complete position to the home position by a pair of guides 107 disposed in the middle of the carriage 16 which project outward to engage parallel channels 108 which are milled in downwardly depending sides 110 of the head 20. The width of the guides 107 is less than the diameter of the wheels 104 and 105 which reduces the width of the downwardly depending sides 110 necessary to retain the carriage 16 from the width which would be necessary if the channels were milled to the diameter of the wheels 104 or 105 as is conventional with many imprinter designs. Furthermore, the use of the guides 107 as a retainer within the channels 108 for the carriage 16 for the returning of the rolling platen 18 from the print complete position to the home position permits larger diameter wheels to be positioned in proximity to the rolling platen 18. Large diameter wheels function as a substantial and durable support for the carriage 16 during the high forces which are generated during the rolling of the rolling platen 18 across the raised faces of the characters and letters on the various elements located on the receiving surface 22. With a conventional design which has channels for retaining wheels supporting a carriage, different size wheels could not be utilized as illustrated. A pull link 112 is pivotably connected to the frame 90 at pivot point 114 which is located midway across the width of the carriage 16. The end 116 of the pull link is bifurcated to permit it to slide past end 118 of frame 90. The pull link 116 moves from the position illustrated in FIG. 1 in proximity to the side 120 of frame 90 toward side 122 of the frame as the head is rotated from its open position to its closed position. During the movement of the head from its open position to its closed position, the vertically pivotable arm 84 moves downward. A connecting pin 124, which is rotatably journalled in the bifurcated end 116 of the pull link 112 has an aperture, not illustrated, which receives pin 88 of arm 84. As the head 20 rotates from its open position to its closed position, the rotatably mounted pin 124, as viewed from its bottom side, rotates in a counterclockwise direction.

Figure 2:
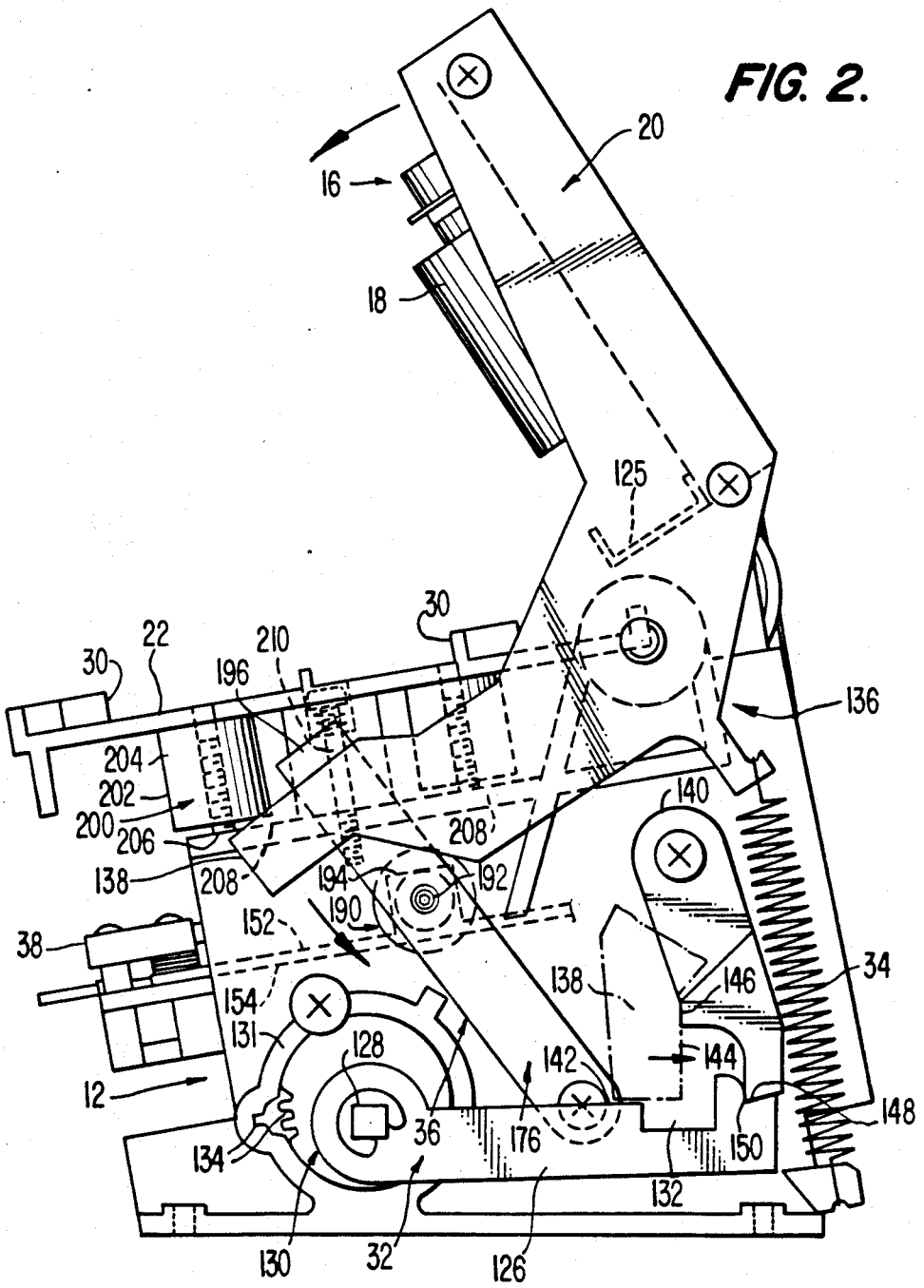
FIG. 2 is a side view of an imprinter in accordance with the present invention with the head open.
Figure 3:
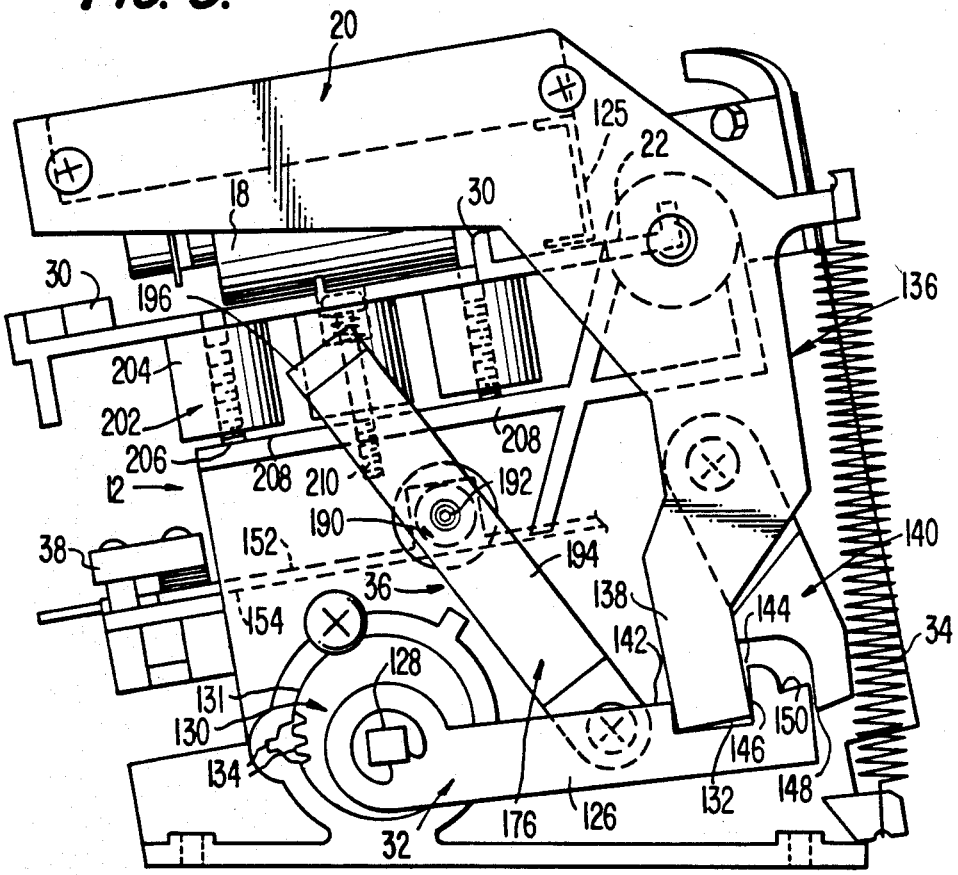
FIG. 3 is a side view of an imprinter in accordance with the present invention with the head in the closed position.
Figure 8:
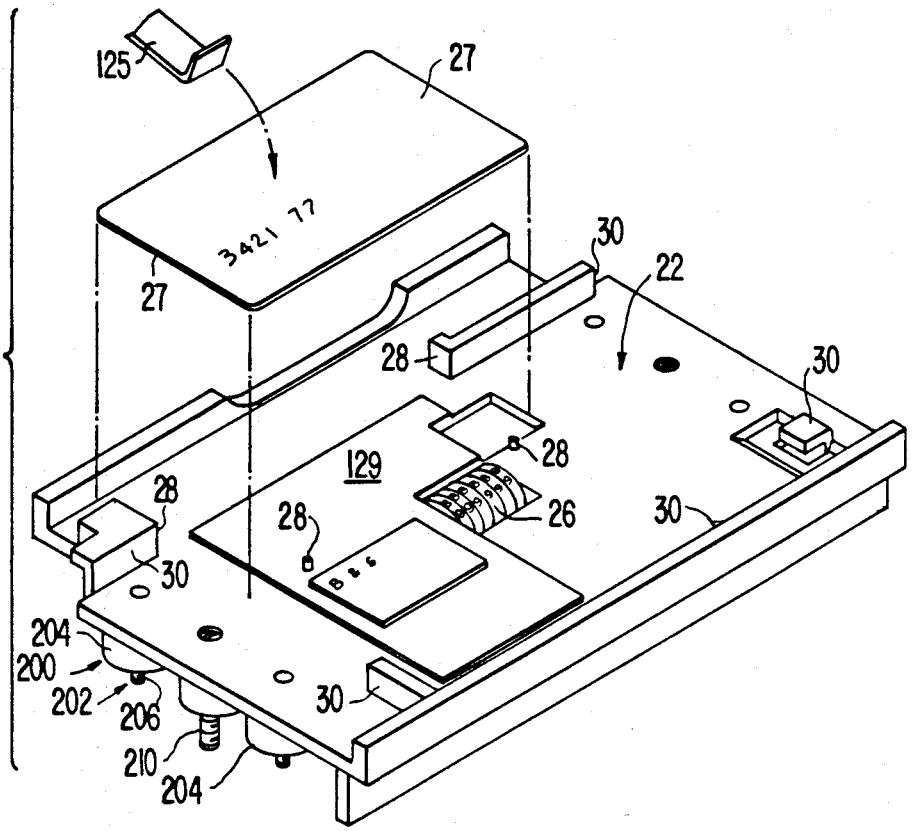
FIG. 8 is a perspective view of the receiving surface of the base.
Figure 4:
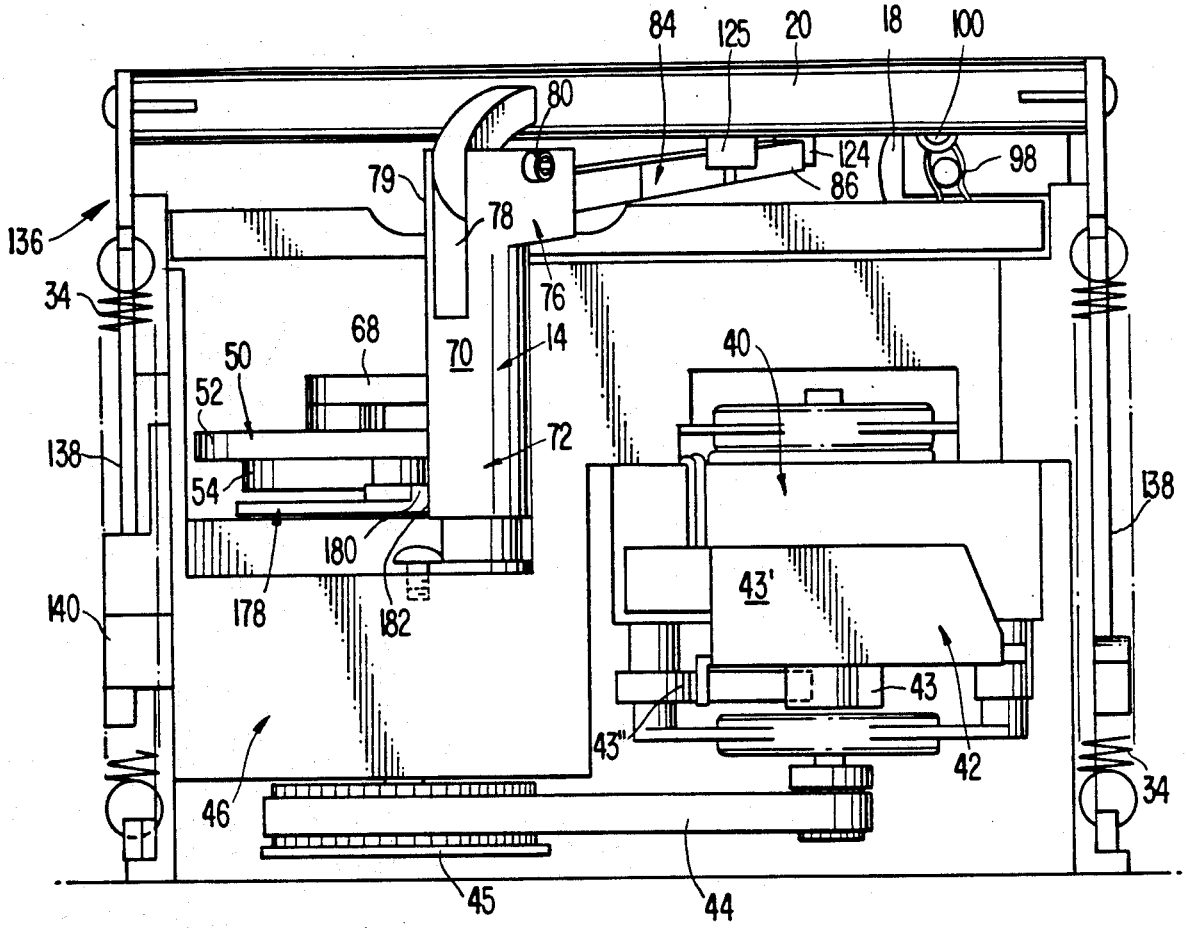
FIG. 4 is a rear view of the present invention with the head in the closed position.
Figure 10:
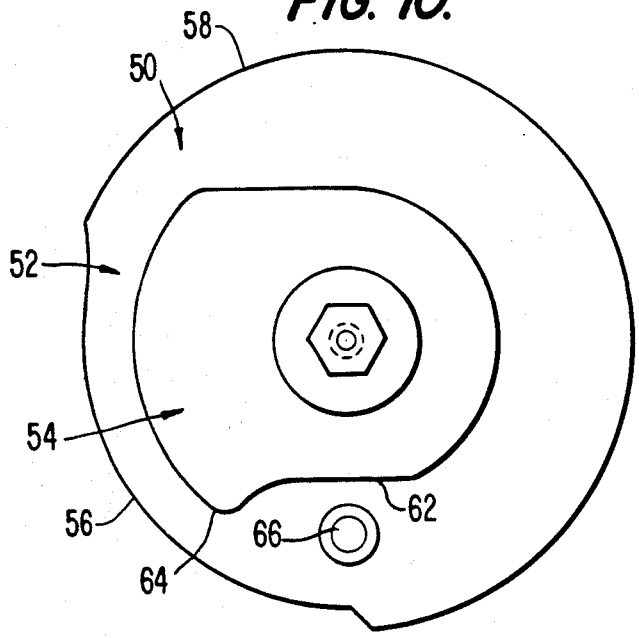
FIG. 10 is a plan view of the bottom side of the cam for partially controlling motor activation and the unlatching of the head.
Figure 5:
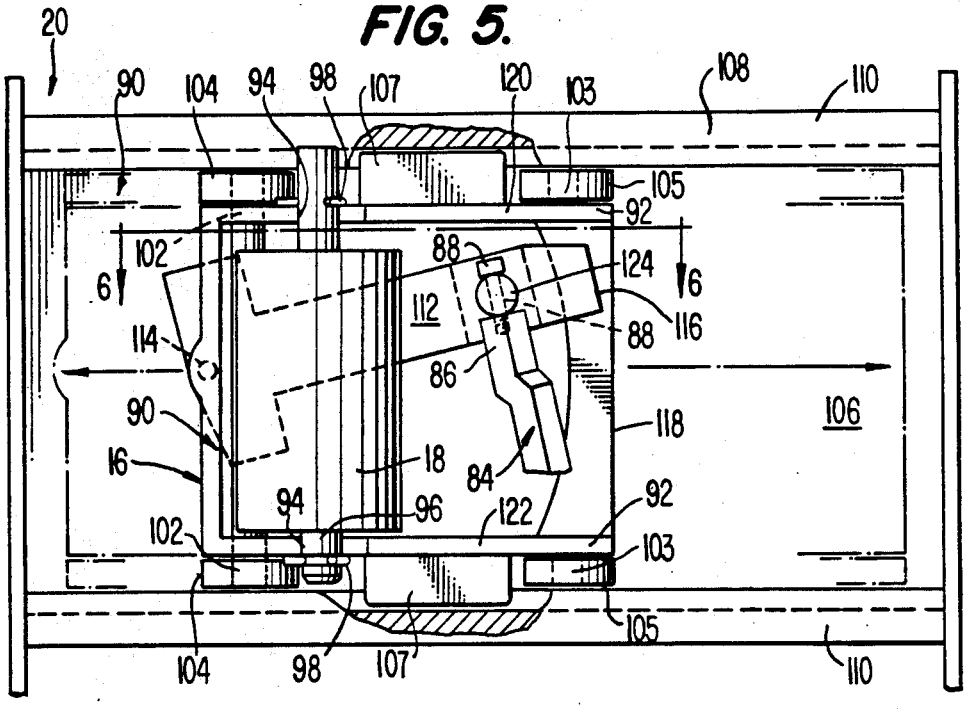
FIG. 5 is a front elevational view of the head in the open position.
Figure 6:
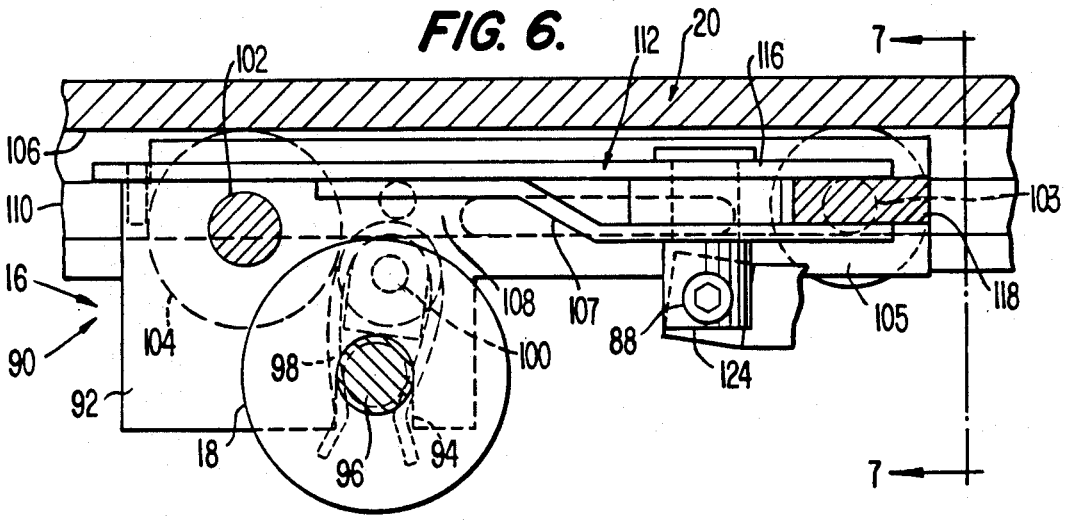
FIG. 6 is a sectional view of FIG. 5 along section lines 6—6.
Figure 7:
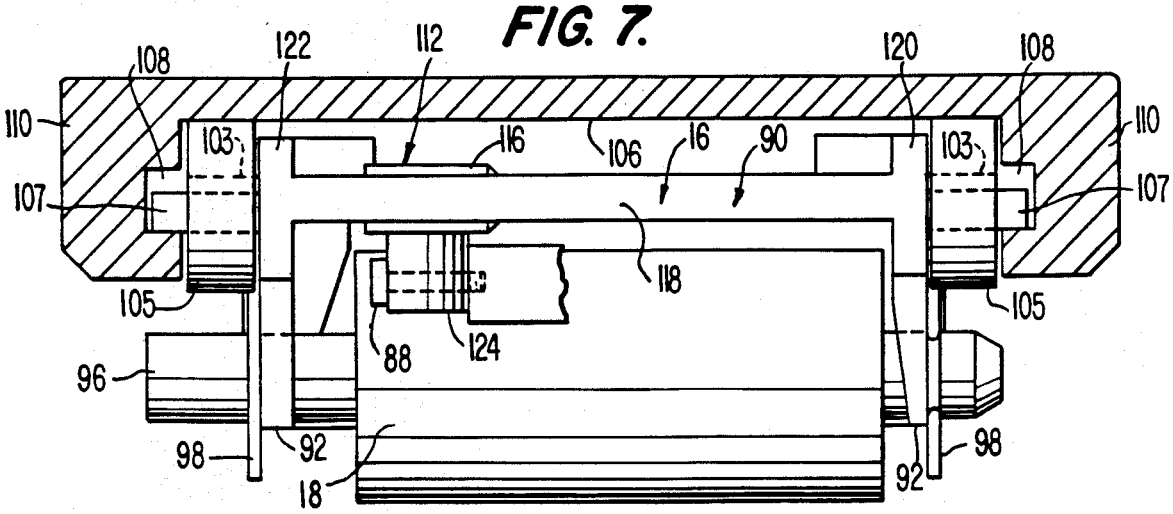
FIG. 7 is a sectional view of FIG. 6 taken along section lines 7—7.
Figure 9:
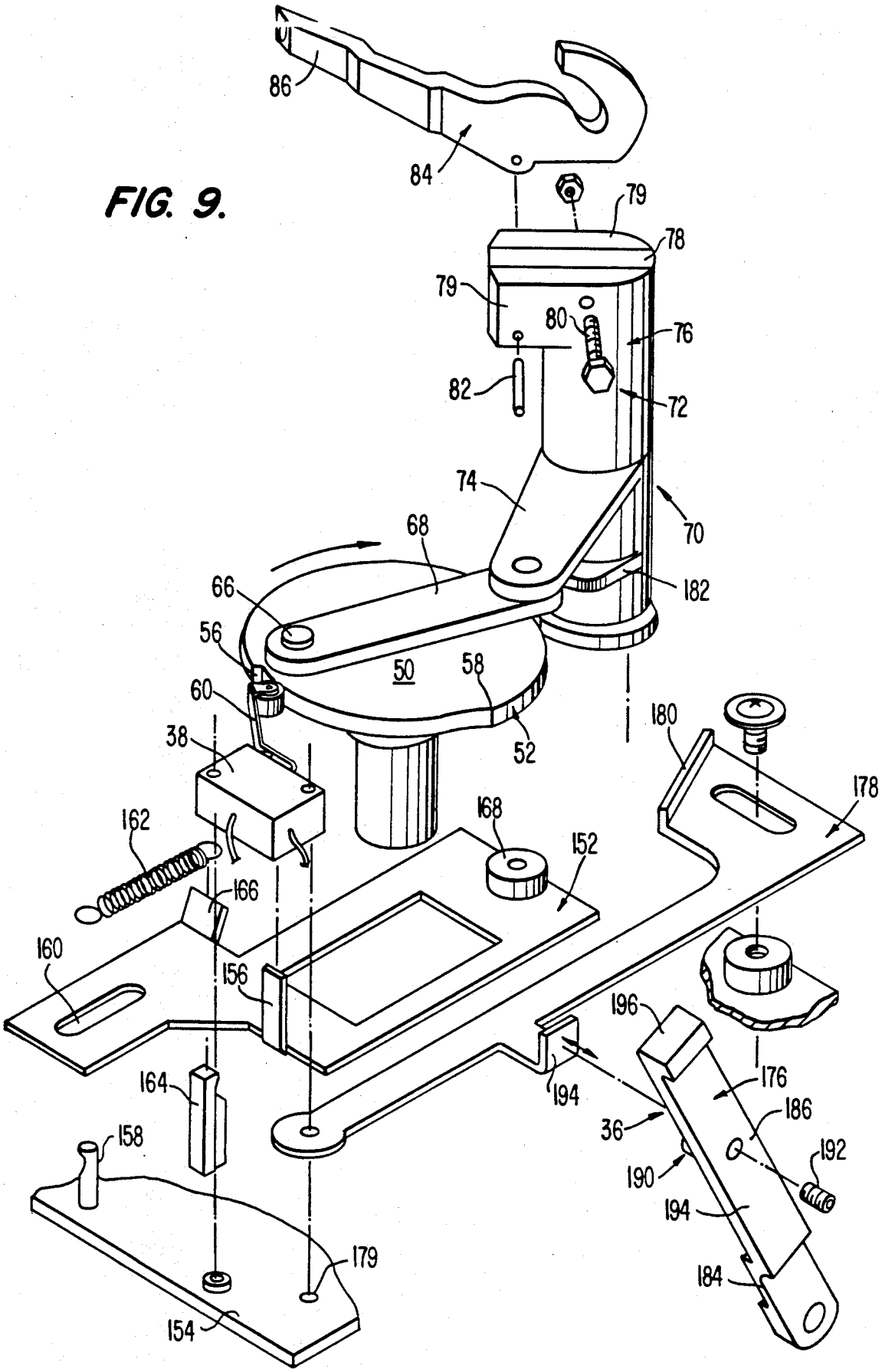
FIG. 9 is an exploded view illustrating parts of mechanisms for controlling the imprinting cycle.
Figure 11:
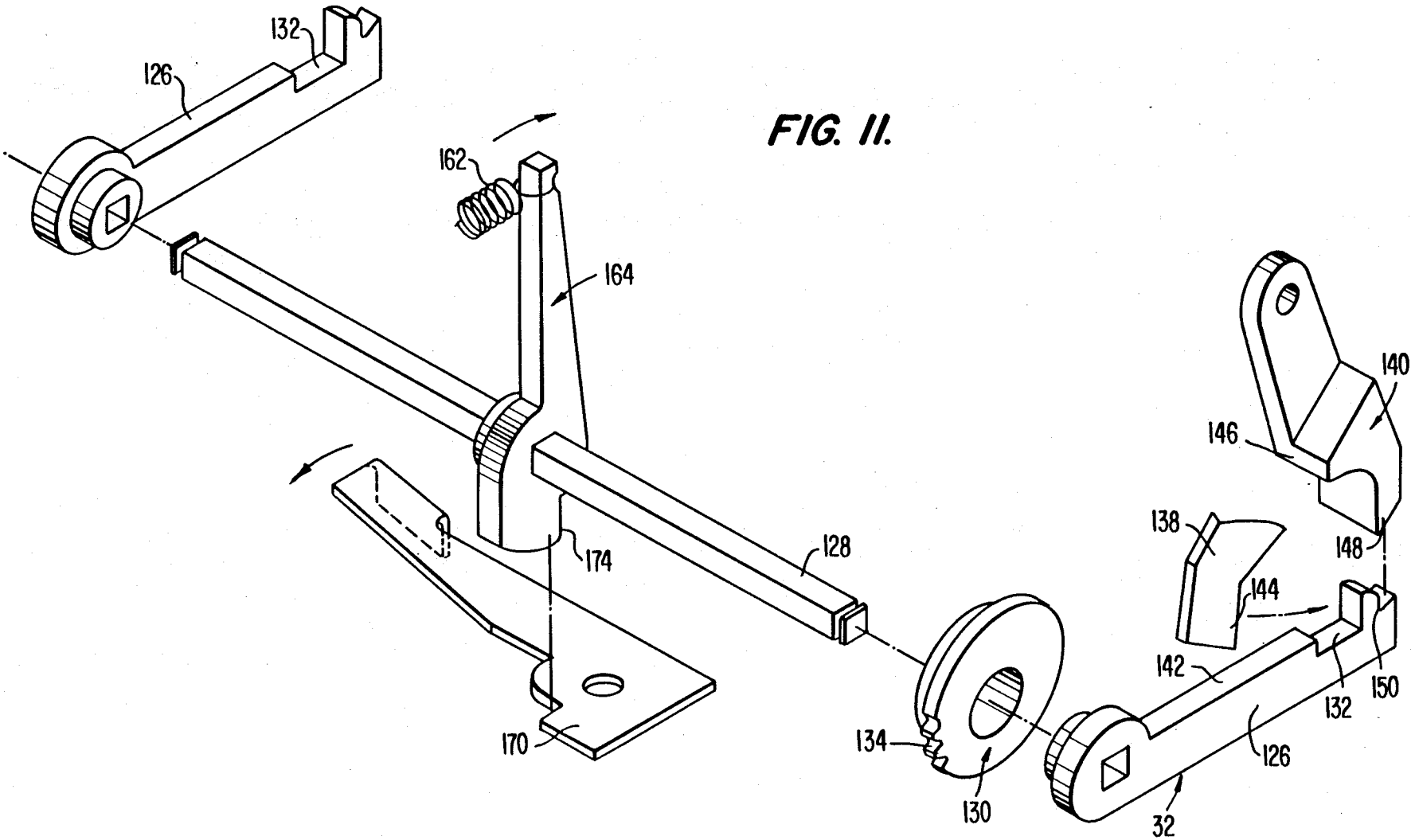
FIG. 11 is an exploded view of parts of the latching mechanism.
Figure 13:
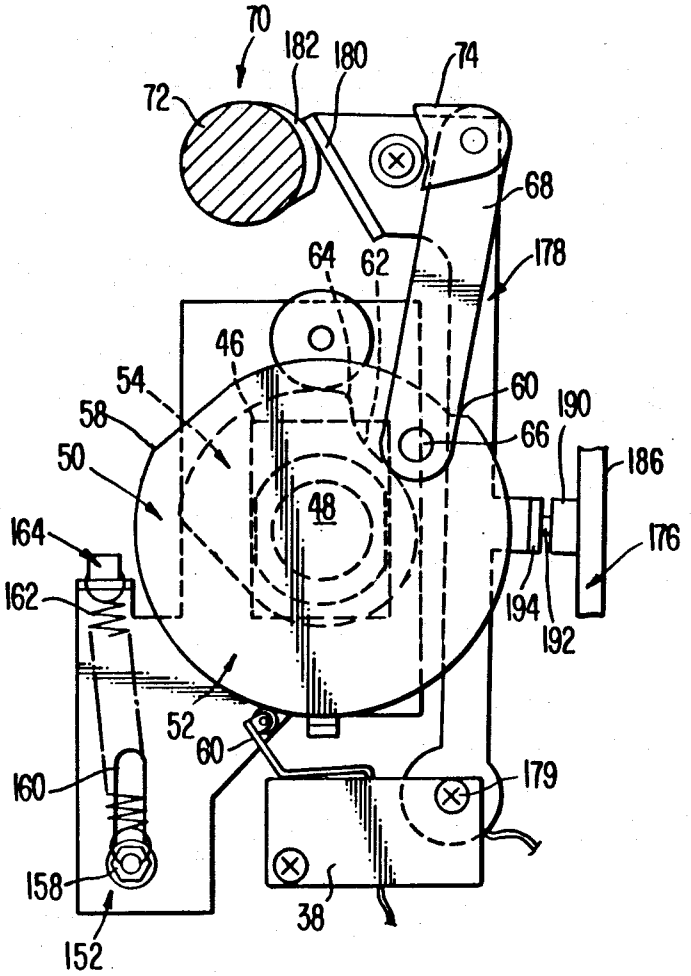
FIG. 13 is a plan view illustrating the second position of the head arresting mechanism.
Figure 12:
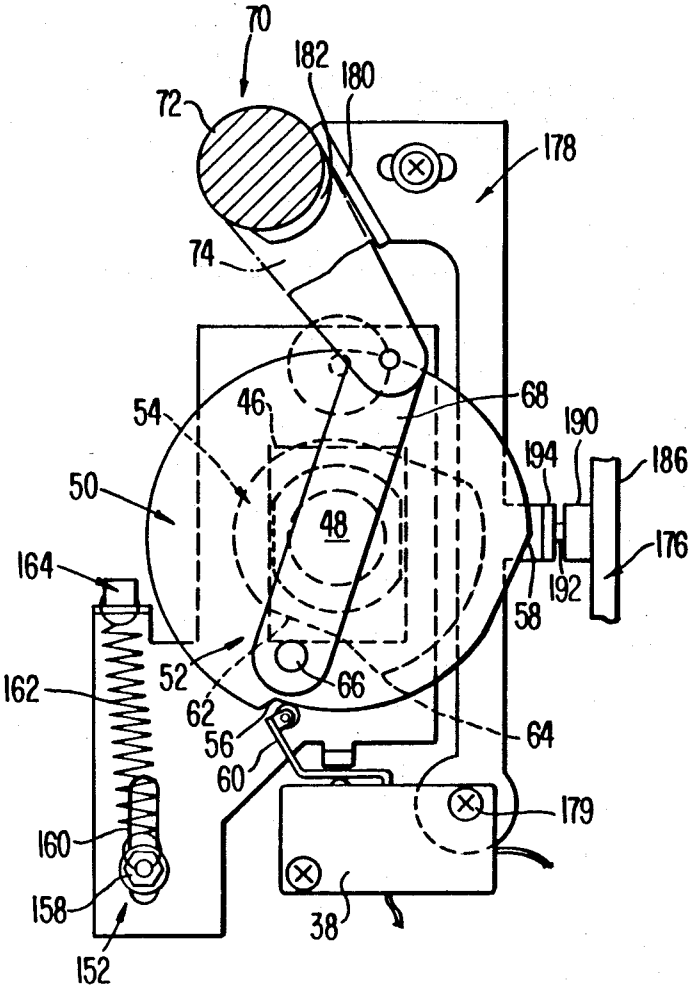
FIG. 12 is a plan view illustrating the first position of the head arresting mechanism.

As illustrated in FIGS. 2, 3 and 8, a card retainer 135 projects downward from the back side of head 20 which holds the credit card 27 held in retainer 28 lightly in place on the receiving surface 22 while the head is in its closed position. The card retainer 125 prevents an edge of the credit card 27 from being displaced upward when the rolling platen 18 engages an opposing left or right edge during imprinting. Upward displacement of an edge opposite the edge contacting the rolling platen 18 would occur because the card overhangs the raised flat platen 129 which is smaller lengthwise than the credit card 27. The raised flat platen 129 has a higher profile than the surrounding part of receiving surface 22. The overhand of the credit card 27 over the raised flat platen 129 is known to prevent smudging on the edge of an OCR field which can be falsely read as an OCR character.

IV. Latching Mechanism

The latching mechanism 32 is illustrated in FIGS. 2, 3, 9 and 11. The latching mechanism 32 has a pair of latches 126 which are rotatably mounted in opposed ends of the base 12. The latches 126 are connected to an axle 128 which extends between the two latches. An eccentric mounting 130 is mounted within a bore 131 within one side of the base 12 to permit the position of the notches 132, which are located in each latch 126 at a point remote from the axis of rotation of the latches, to be adjusted. Teeth 134 are cut in the eccentric mounting 130 and in the side of the bore 131 to permit a screwdriver to be used to perform the adjustment described, supra. Each side 136 of the head 20 has an elongated section 138 which is machined to fit within the corresponding notch 132. A pawl 140 is rotatably mounted on one side 136 of the base 12 as illustrated. The pawl 140 functions to hold the individual latches 126 in a position which permits the elongated sections 138 to rotate into an angular position almost in alignment with the notches 132 without substantially engaging the top surface 142 of the latches 126. As the elongated sections 138 rotate toward an angular position which engages the notches 132 during closing of the head 20, surface 144 of the elongated section 138 engages surface 146 of the pawl 140 to cause it to rotate in a counterclockwise direction which frees the V-shaped section 148 from engagement of the notch 150 of the latch 126. As the pawl 140 rotates counterclockwise to a position where the V-shaped section 148 clears engagement with one of the latches 126, a spring bias causes the latches 126 to rotate upward to cause the notch 132 engage the elongated section 138. One of the springs 34 biases the pawl 140 into the position in which the V-shaped section 148 normally engages the notch 150. Plate 152, which is mounted slidably on surface 154 of the base 12, has a vertically extending section 156 which engages the switch 38 when the slidable plate is moved toward the front of the base 12. Post 158, which may be a threaded member having a retaining nut and washer, slidably engages plate 152 through elongated aperture 160 to guide the sliding of the plate toward and away from the base as described, infra. A stretched spring 162 is attached to the post 158 and a vertically extending member 164 which is connected to the axle 128 of the latches 126. The spring 162 causes the latches 126 to rotate upward once the pawl 140 has been pushed away from retaining one of the latches. The sliding plate 152 has a slanted vertically extending surface 166 which engages the vertically extending member 164 to cause the vertically extending member to be forced toward the rear of the base 12 to rotate the latches 126 downward to free the elongated sections 138 from its engaging notch 132 to permit the head 20 to rotate to its open position. The slidable plate 152 has a wheel 168 mounted thereon which engages the control surface 54 of cam 50 as the second surface rotates to a position which engages the wheel. Continued rotation of the cam 50 after the wheel 168 engages the second control surface 54 forces the slidable plate 152 toward the rear of the base 12 which causes the slanted vertically extending surface 166 to force the vertically extending member 164 toward the rear of the base. Movement of the slanted vertically extending surface 164 toward the rear of the base 12 causes the latches 126 to rotate downward to unlatch the head 20. A release level 170 is pivotably mounted to the bottom side of the base 12 to permit the unlatching of the latches 126. Rotation of the release lever 170 from a first position to a second position engages an extension 174 of vertically extending member 164 which causes the latches 126 to be rotated vertically downward to unlatch the head 20. The function of the release lever 170 is to permit the head to be unlatched from its closed position when a power failure or a jam occurs during imprinting.

V. Head Braking Mechanism

The head braking mechanism 36 is illustrated in FIGS. 2, 3, 12 and 13 9. The head braking mechanism 36 consists of the head arrestor 176 and an actuator 178 for the head arrestor. The head arrestor 176 is connected to one side of the base 12 and extends generally vertically upward to frictionally engage the elongated section 138 upon opening of the head 20. The actuator 178 moves the head arrestor 176 prior to opening of the latches 126 from a first position to a second position which frictionally engages the elongated section 138 to brake the rate at which the head opens under the influence of springs 34. The actuator 178 is pivoted attached to surface 154 at the corner 179 of the switch 38. The actuator 178 has a surface 180 which engages a cam surface 182 which is part of the bell crank 72. When the rolling platen 18 moves to the print complete position, the cam surface 182 engages the surface 180 of the actuator to cause it to pivot to force the head arrestor from its first position to its second position to brake the rate of opening of the head 20. The thin section 184 of the head arrestor 176 bends when the head arrestor is forced from its first position to its second position by engagement with the actuator 178. The positive engagement of the cam surface 182 of the bell crank with the surface 180 of the actuator 178 applies sufficient frictional drag to the opening of the head 20 to produce a smooth controlled opening of the head which is desirable from an aesthetic operational point and from the further standpoint of avoiding possible mechanical wear or breakage while providing positive opening for every cycle. When the head 20 is open, the outside surface 186 of the head arrestor 176 is slightly offset from the inside surface of the elongated section 138. The braking of the rate of opening of the head is produced by the actuator 178 forcing the head arrestor 176 outward to its second position prior to opening of the latching mechanism 32 which causes frictional drag between the outside surface 186 with the inside surface of the elongated section 138 when the head 20 is opened. The head arrestor 176 has an adjustment mechansim 190 which extends inward through an aperture cut in the side 136 of the base 12 which contains a threaded member 192 that controls the point of engagement of the end of the threaded member with an upwardly projecting part 194 of the actuator 178 which lies between the pivot point 179 and the surface 180. The top of the head arrestor has a stop 196 which stops the rotation arrestor 176 is made from a plastic such as DELRIN which has reproducible drag characteristics over many cycles of engaging a metallic surface.

VI. Height Adjustment Mechanism for Imprinting Surface

The height adjustment mechanism for the imprinting surface 22 is illustrated in FIGS. 2, 3 and 8. Four height adjusters 200 are provided for establishing a fixed vertical position of the receiving surface 22 with respect to the rolling platen 18 when the head 20 is in its closed position. Each height adjuster 200 has a threaded member 202 which engages a cylinder 204 extending downwardly from the receiving surface 22. The end 206 of each threaded member 202 rests on a datum surface 208 contained within the base 12. Fasteners 210 fix the receiving surface 22 to the base 12.

VII. Operation

An imprinter in accordance with the present invention operates as follows. As illustrated in FIG. 1, a credit card 27 is positioned in retainer 28 and a formset 29 is positioned in retainer 30 to prepare the imprinter for forming an imprint of the station plate 24, dater 26 and credit card retained by retainer 28 on the formset retained by retainer 30. The operated pivots the head 20 from its open position to a closed position which activates the imprinting cycle. During the closing of the head 20, the bell crank 72 is maintained in a fixed rotary position and the vertically pivotable arm 84 pivots downward which causes the rolling platen 18 carried by the carriage 16 to be returned to its home position. During downward movement of the head 20, the pull link 112 rotates downward from the position as illustrated in FIG. 1 away from side 120 of frame 90 towards side 122. As the head 20 is rotated toward its closed position, the pawl 140 is rotated away from engagement of one the latches 126 which permits the latches to rotate upward under spring bias to have the notches 132 engage elongated section 138 under the action of spring 162. As the elongated sections 138 drop into their notches 132, the vertically extending member 164 pushes slidable plate 152 towards the front of the base 12 which causes vertically extending section 156 to close switch 38 to activate the motor 40. As the head 20 closes, the card retainer 125 pivots into contact with the upper middle part of the credit card 27 to retain it in a fixed vertical position with respect to the flat platen 129. As the motor 40 rotates, the cam 50 is rotated under the drive of transmission 46 in a clockwise direction. The bell crank 72 rotates through an angle of approximately 60° to cause the rolling platen 18 to be moved from its home position to its print complete position. During the rotation of the cam 50, the portion 58 rotates into engagement with the contact arm 60 to hold the switch 38 in a closed position which frees the control of the motor from the closure of the head 20. As the rolling platen 18 reaches the print complete position, the wheel 168 engages the control surface 54 of the cam 50 to cause the slidable plate 152 to move toward the back of the base 12 to cause the vertically extending member 164 to be pushed toward the back of the base by engagement with the vertically extending surface 166 of the slidable plate 152 which causes the elongated section 138 to be disengaged from the notches 132 to permit the head 20 to rotate to the open position under the influence of springs 34. The control surface 52 of the cam 50 maintains the switch 38 in a closed position until the first surface rotates to the park position 56. As soon as the cam 50 has rotated to the park position 56 of the control surface 52, the motor 40 is deactivated. The motor brake 42 causes the motor to stop in a fixed position which causes the rolling platen 18 to be positioned as illustrated in FIG. 1. Once the elongated sections 138 clear notches 132, the springs 34 cause the head to rotate toward the open position. The cam surface 182 on the bell crank 72 causes the actuator 178 to pivot toward the side of the base 12 from the first position to the second position to cause the head arrestor 176 to be pushed outward to engage the elongated section 138 to create a frictional drag which brakes the rotation of the head 20 to prevent it from slamming against the top of the head arrestor. The resiliency of the head arrestor 176 causes it to spring back to a position where it is not rubbing against the elongated section 138 once the bell crank 72 has rotated back to the position as illustrated in FIG. 1. The imprinter is now in condition to permit the user to remove the imprinted formset 29 and the credit card 27 from the receiving surface 22 which leaves the imprinter in condition to perform another imprinting cycle a described above.

While the invention has been disclosed in terms of its preferred embodiments, it should be understood that numerous modifications may be made thereto without departing from the spirit and scope of the appended claims.

We claim:

1. In a motor operated imprinter of the type having a base having means for receiving a print bearing element having printing to be imprinted and a print receiving element to be imprinted with the printing by a motor powered rolling platen means as it moves from a first position to a second position, a head means pivotably connected to the base which is pivotable between an open position, providing access to the means for receiving, and a closed position positioning the head means for imprinting, a latching means, having latched and unlatched positions, for holding the head in its closed position when latched; and means for causing the head means to rotate to its open position upon the unlatching of the laching means, a mechanism for braking the rotation of the head means from its closed position to its open position comprising:

(a) a head arrestor means having a first position which does not engage the head means and a second position which engages a part of the head means during rotation of the head means to the open position to brake the rate of pivoting of the head means to the open position; and (b) means for moving the head arrestor means from the first position to the second position into engagement with the part of the head means in response to movement of the rolling platen means toward the second position which causes the head means to pivot at a braked rate of pivoting.

2. A motor operated imprinter in accordance with claim 1 wherein the head arrestor means comprises a member which extends upward from a point of attachment to the base to at least a point which can engage the means for moving the head arrestor means, the member having a flexible section which bends when the head arrestor means is moved from the first position to the second position.

3. A motor operated imprinter in accordance with claim 2 wherein the head arrestor means further comprises:

an adjusting means for adjusting the position at which the means for moving the head arrestor means engages the head arrestor means to cause movment from the first position.

4. A motor operated imprinter in accordance with claim 3 wherein the means for adjusting is a threaded member which engages a threaded bore in the head arrestor means.

5. A motor operated imprinter in accordance with claim 4 wherein the head arrestor means is made form plastic.

6. A motor operated imprinter in accordance with claim 1 wherein the means for moving the head arrestor means comprises:

(a) a pivoted member attached to the base with a cam engaging surface located at a point remote from the pivot point and a protrusion at a point between the pivot point and the cam engaging surface which engages the head arrestor means upon pivoting of the pivoted member; and (b) a head arrestor activation cam which is rotated upon activation of the motor which engages the cam engaging surface when the rolling platen means is moving to a print complete position to cause the pivoted member to rotate to a position where the protrusion has moved the head arrestor means to its second position whereby upon unlatching of the head means the head arrestor means engages the projections of the head means to brake the rate of pivoting of the head means.

7. In a motor operated imprinter having a rolling platen driven by the motor from a home position to a print complete position, a motor braking means for stopping the rotation of the motor in response to the opening of a switching means to cause the rolling platen to be stopped in a fixed position comprising:

(a) a pawl catching means coupled to an output shaft of the motor which has a slip coupling to the shaft of the motor to permit the shaft to continue to rotate for a predetermined amount after the pawl catching means has been stopped from rotating;

(b) a pawl which is movable from a first position which does not engage the pawl catching means to a second position which stops the pawl catching means; and (c) means for moving the pawl from the second from the first position to the second position when the motor is deactivated.

8. A motor operated imprinter comprising:

(a) a base having means for receiving a print bearing element having printing to be imprinted and a print receiving element to be imprinted;

(b) head means pivotably connected to the base which is pivotable between an open position, providing access to the means for receiving, and a closed position positioning the head means for imprinting;

(c) movable carriage means mounted in the head means having mounted therein a rolling platen means movable from a first position to a second position to traverse the rolling platen means across at least the part of the base which receives the print bearing element and the print receiving element and movable from the second position back to the first position; and (d) means for driving the carriage means including:

(i) a motor mounted in the base;

(ii) a transmission means coupling the motor to the movable carriage means comprising a coupling means having a rotatably driven shaft with a fixed axis of rotation extending upward from the base, a linkage means having a first end pivotably coupled to the rotatably driven shaft at a point remote from the base and a second end which is coupled to the movable carriage means, said linkage means being pivotable with respect to the rotatably driven shaft and upon closing of the head means the linkage means pivoting with respect to the rotatably driven shaft to cause the rolling platen means to move to its secodn position; and (iii) control means for activating the motor in response to the closing of the head means and for deactivating the motor after the rolling platen means has reached the second position, and activation of the motor causing the rolling platen means to be moved from its first position to the second position to cause imprinting when the print receiving element and the print bearing element are positioned on the base.

9. A motor operated imprinter as in claim 8 wherein:

(a) the first position of the rolling platen means is a position at which the rolling platen means is disposed when the head means is closed and the second position is a position at which the rolling platen means is disposed when the head means is opened;

(b) the driven shaft extends orthogonally from the base; and (c) the linkage means is pivotable in a plane which is parallel to the fixed axis of rotation.

10. A motor operated imprinter as in claim 9 wherein the linkage means is pivotable in a plane which is parallel to and intersects the fixed axis of rotation.

11. A motor operated imprinter as in claim 8 further comprising:

(a) a latching means, having latched and unlatched positions, for holding the head means in its closed position when latched;

(b) means activated after the movement of the rolling platen means to its second position to unlatch the latching means;

(c) means for causing the head means to pivot to its open position upon the unlatching of the latching means; and (d) the control means including switching means closed by the latching of the latching means to activate the motor to cause the rolling platen means to move from its first position toward its second position and opened to deactivate the motor after the rolling platen means has moved to its second position.

12. A motor operated imprinter in accordance with claim 11 wherein the means for causing the head means to rotate to its open position includes a means for braking the rate of rotation of the head means to its open position.

13. A motor operated imprinter in accordance with claim 12 wherein the means for braking the rotation of the head means to the open position comprises:

(a) a head arrestor means which is movable from a first position which does not engage the head means to a second position in engagement with a part of the head means during rotation of the head means to the open position to brake the rate of pivoting of the head means to the open position; and (b) means for moving the head arrestor means from the first position toward the second position into engagement with the part of the head means in response to movement of the rolling platen means toward the second position which causes the head means to pivot at a braked rate of pivoting.

14. A motor operated imprinter in accordance with claim 11 wherein the latching means comprises:

(a) a pair of latches which respectively have a rotatable mounting point on different ends of the base and which each have notches cut at a point remote from the rotatable mounting point for receiving a pair of projections at opposed ends of the head means for latching the means in its closed position, said pair of latches being biased by a means for causing rotation to rotate in a direction to cause the notches to engage the projections;

(b) a movable pawl for engaging one of the latches in a first position to stop the rotation of the latches prior to rotation to a position where the notches engage the projections and being movable to a second position by engagement of one of the projections to permit the latches to rotate into engagement with the projections to lock the head in its closed position.

15. A motor operated imprinter in accordance with claim 14 wherein the head arrestor means comprises a member which extends upward from a point of attachment to the base to at least a point which can engage the means for moving the head arrestor means, the member having a flexible section which bends when the head arrestor means is moved from the first position to the second position.

16. A motor operated imprinter in accordance with claim 15 wherein the head arrestor further comprises:

an adjusting means for adjusting the position at which the means for moving the head arrestor engages the head arrestor means to cause movement from the first position.

17. A motor operated imprinter in accordance with claim 16 wherein the means for adjusting is a threaded member which engages a threaded bore in the head arrestor means.

18. A motor operated imprinter in accordance with claim 14 wherein the means for moving the head arrestor means comprises:

(a) a pivoted member attached to the base with a cam engaging surface located at a point remote from the pivot point and a protrusion at a point between the pivot point and the cam engaging surface which engage the head arrestor means upon pivoting of the pivoted member; and (b) a head arrestor activation cam which is rotated upon activation of the motor which engages the cam engaging surface when the rolling platen means is moving to the second position to cause the pivoted member to rotate to a position where the protrusion has moved the head arrestor means to its second position whereby upon unlatching of the head the head arrestor means engages the projections of the head means to brake the rate of pivoting of the head means.

19. A motor operated imprinter in accordance with claim 18 wherein the rotatably driven shaft comprises:

a vertically extending rotatably mounted crank with an arm extending from the crank which is rotated in response to activation of the motor to cause rotation of the crank.

20. A motor operated imprinter in accordance with claim 8 wherein the rotatably driven shaft comprises:

a vertically extending rotatably mounted crank with an arm extending from the crank which is rotated in response to activation of the motor to cause rotation of the crank.

21. A motor operated imprinter in accordance with claim 20 wherein the second end of the linkage means comprises a coupling which permits the second end to move with respect to a point of attachment to the movable carriage means as the rolling platen means moves to its second position upon closure of the head.

22. A motor operated imprinter in accordance with claim 21 wherein said movable carriage means comprises:

(a) a frame having a plurality of wheels for rotatably supporting the movable carriage means during movement of the rolling platen means from the first position to the second position; and (b) a pull link having a first end pivotably connected to the frame and a second end pivotably connected to the second end of the linkage means, the pull link pivoting with respect to the frame and pivoting with respect to the second end of the linkage means as the head means pivots from its open position to its closed position as the linkage means pivots vertically with respect to the end of the rotatably driven shaft.

23. A motor operated imprinter in accordance with claim 8 wherein the movable carriage means comprises:

(a) a frame having a plurality of wheels which rotatably support the frame during movement of the rolling platen means from the first position to the second position and a pair of guides mounted on opposed sides of the frame which extend outward from the sides, the guides having a width less than the diameter of the wheels and wherein;

(b) a pair of opposed channels extending longitudinally along the head means in a direction parallel to the direction of motion of the movable carriage means which respectively engage the guides to retain the carriage means in a uniformly spaced relationship with respect to a flat underside surface of the head means during movement of the rolling palten means from the second position to the first position, each of the wheels supporting the movable carriage means on the flat underside surface upon movement of the rolling platen means from the first position to the second position.

24. A motor operated imprinter in accordance with claim 11 wherein the control means further comprises:

(a) a cam means rotatably driven in response to activation of the motor, the cam means having first and second control surfaces for respectively controlling the activation cycle of the motor and the unlatching of the latching means in response to movement of the rolling platen means to its second position;

(b) means coupling the cam means with the first and second surfaces to the coupling means to cause the rolling platen means to move from its first position to its second position and partially back to its first position in response to the motor being activated;

(c) and wherein the closure of the switching means is controlled by the first surface of the cam means after the latching means is latched until the cam means rotates to a park position; and (d) the latching means is unlatched by the second surface of the cam means after movement of the rolling platen means to its second position.

25. A motor operated imprinter in accordance with claim 24 wherein:

(a) the means coupling the cam means to the coupling means comprises a linkage having a first and second end with the first end being pivotably connected to the cam means;

(b) the rotatably driven shaft comprises a rotatably mounted crank with an arm extending from the crank which is pivotably connected to the second end of the linkage which is rotated in response to activation of the motor to cause rotation of the crank.

26. A motor operated imprinter in accordance with claim 8 wherein the means for receiving comprises:

(a) a flat surface having means for holding the print carrying element and the print receiving element in a fixed position; and (b) means for adjusting the vertical position of the flat surface with respect to the base to achieve a desired position of the surface with respect to the rolling platen means when the head means is in the latched position.

27. A motor operated imprinter in accordance with claim 26 wherein the means for adjusting further comprises:

(a) a plurality of height adjusters which each engage the means for receiving at spaced apart locations;

(b) a plurality of reference surfaces, each reference surface being contained in the base and contacting a different one of the height adjusters to establish a position of the flat surface with respect to the base; and (c) a fastening means for connecting the means for receiving to the base to fixedly establish the position of the flat surface with respect to the base which is determined by the spacers.

28. A motor operated imprinter comprising:

(a) a base having means for receiving a print bearing element having printing to be imprinted and a print receiving element to be imprinted;

(b) a head means pivotably connected to the base which is pivotable between an open position, providing access to the means for receiving, and a closed position positioning the head means for imprinting;

(c) a movable carriage means mounted in the head means having mounted therein a rolling platen means movable from a first position to a second position and movable from the second position back to the first position; and (d) means for driving the carriage means including:

(i) a motor mounted in the base;

(ii) a transmission means coupling the motor to the movable carriage means comprising a coupling means having a rotatably driven shaft with a vertically extending axis of rotation, a linkage means having a first end pivotably coupled to the rotatably driven shaft and a second end which is coupled to the carriage, said linkage means being pivotable with a component of motion in a vertical plane with respect to the rotatably driven shaft and upon closing of the head means the linkage means pivoting with the component of motion in the vertical plane with respect to the rotatably driven shaft to cause the rolling platen means to move to its first position; and (iii) control means for activating the motor in response to the closing of the head means and for deactivating the motor after the rolling platen means has reached the second position, and activation of the motor causing the rolling platen means to be moved from its first position to the second position to cause imprinting when the print receiving element and the print bearing element are positioned on the base.

* * * * *